US006257497B1

(12) United States Patent
Pham

(10) Patent No.: US 6,257,497 B1
(45) Date of Patent: Jul. 10, 2001

(54) WATER EJECTING DEVICES FOR FOUNTAINS

(75) Inventor: Long N. Pham, Westminster, CA (US)

(73) Assignee: Long Pham, Westminster, CA (US)

( * ) Notice: Subject to any disclaimer, the term of this patent is extended or adjusted under 35 U.S.C. 154(b) by 0 days.

(21) Appl. No.: 09/357,120

(22) Filed: Jul. 19, 1999

(51) Int. Cl.[7] ..... B05B 17/04; B05B 17/08
(52) U.S. Cl. ..... 239/17; 239/12
(58) Field of Search ..... 239/17, 22, 23, 239/99; 4/496, 492; 141/110

(56) References Cited

U.S. PATENT DOCUMENTS 3,633,822 * 1/1972 Hruby, Jr. ..... 239/17
4,472,256 * 9/1984 Hilbig ..... 204/266
4,512,517 * 4/1985 Manor ..... 239/206
4,978,066 * 12/1990 Fuller et al. ..... 239/23
5,207,241 * 5/1993 Babb ..... 137/447
5,685,333 * 11/1997 Skaryd ..... 137/514

* cited by examiner

*Primary Examiner*—David A. Scherbel
*Assistant Examiner*—Davis Hwu

(57) ABSTRACT

The main use of the water-ejecting device is for fountain displays. The water-ejecting device is submerged, at least in part, in a fountain pool and is comprised of a water tank with a small, smooth, tapered open end at the top. The bottom of the water tank contains an integral, spring loaded, sliding cylinder to provide automatic water tank refilling, and hydraulic cushion to prevent vibration and noise. A computer-controlled air control valve connects the lower portion of the water tank to a supply of air under pressure. When the air control valve opens, the air under pressure will push water through the taper open end at the top, and display a stream of water. When the air control valve closes, the said water tank will be refilled automatically by the integral spring loaded sliding cylinder.

2 Claims, 4 Drawing Sheets

WATER EJECTING DEVICES FOR FOUNTAINS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to the field of water nozzle devices for water fountains.

2. Prior Art

Various types of air actuating devices are well known in the prior art such as U.S. Pat. No. 151,003, U.S. Pat. No. 914,419, U.S. Pat. No. 3,722,819, Russian Pat. No. 1,228, 804, U.S. Pat. No. 4,978,066. The U.S. Pat. No. 4,512,517 and U.S. Pat. No. 4,472,256 are pertinent to the invention, but the U.S. Pat. No. 4,512,517 refers to an irrigation apparatus, and the U.S. Pat. No. 4,472,256 refers to pool chlorinator.

However, this invention allows automatic refilling the water tank after each firing cycle, and solve the slamming action of refilling means problems by providing a water chamber which functions as a shock absorber. In the past, the prior art is using a check valve for refilling. This slamming problem is caused by quick closing of check valve when air control valve opens. The slamming problem has been a major problem in prior art that causes frequent premature equipment damages and unreliable operations. The slamming action also creates a loud, disturbed noise that limits the use of devices. In some other prior art, a water valve is used to refill the water. This refilling water valve makes the system extremely complicated since it have to be controlled to close and open at the right moment in relation with the air control valve. That is the reason why this invention is more superior and different from the prior art. The patent of Fuller et al. discloses a device with the use of the check valve. The check valve is a device that allows water to flow only in one direction. As a result, the debris from the water basin flows into the device and plugs up the debris inlet strainer (item 32, the patent of Fuller et al) in a very short time, and substantial reduces the refilling capability of the device. Because of this, extensive maintenance is required to clean the debris inlet strainer. This invention is using an automatic refilling and shock absorber, which is a bi-directional flow device, not a check valve. This automatic refilling and shock absorber allows water to flow both ways. When the control valve is turned off, the device is fully open for refilling. When the control valve is turned on, the device is almost closed but not completely. As a result, the leaking water at high pressure will purge the debris out of the debris inlet strainer. Therefore, this device is self-cleaning and requires much less maintenance compared to the prior art.

BRIEF SUMMARY OF THE INVENTION

The water ejecting device is submerged, at least in part, in a fountain pool, and is consisted of a water tank with a small, smooth, tapered open end at the top. The water tank could be simply a large diameter pipe. The bottom of the water tank contains an integral spring loaded, sliding cylinder to provide automatic water tank refilling, and hydraulic cushion to prevent vibration and noise. These vibration and noise are normally caused by slamming action of refilling means when the air control valve opens. This air control valve, which is controlled by a computer, connects the lower portion of the water tank to a supply of air under pressure. When the air control valve opens, the air under pressure will push water through the taper open end at the top, and display a stream of water. When the air control valve closes, the said water tank will be refilled automatically by the integral spring loaded, sliding cylinder which allows fountain pool water to flow in the water tank.

DETAILED DESCRIPTION OF THE INVENTION

The main use of the water ejecting devices is for fountain displays.

Figure 1:
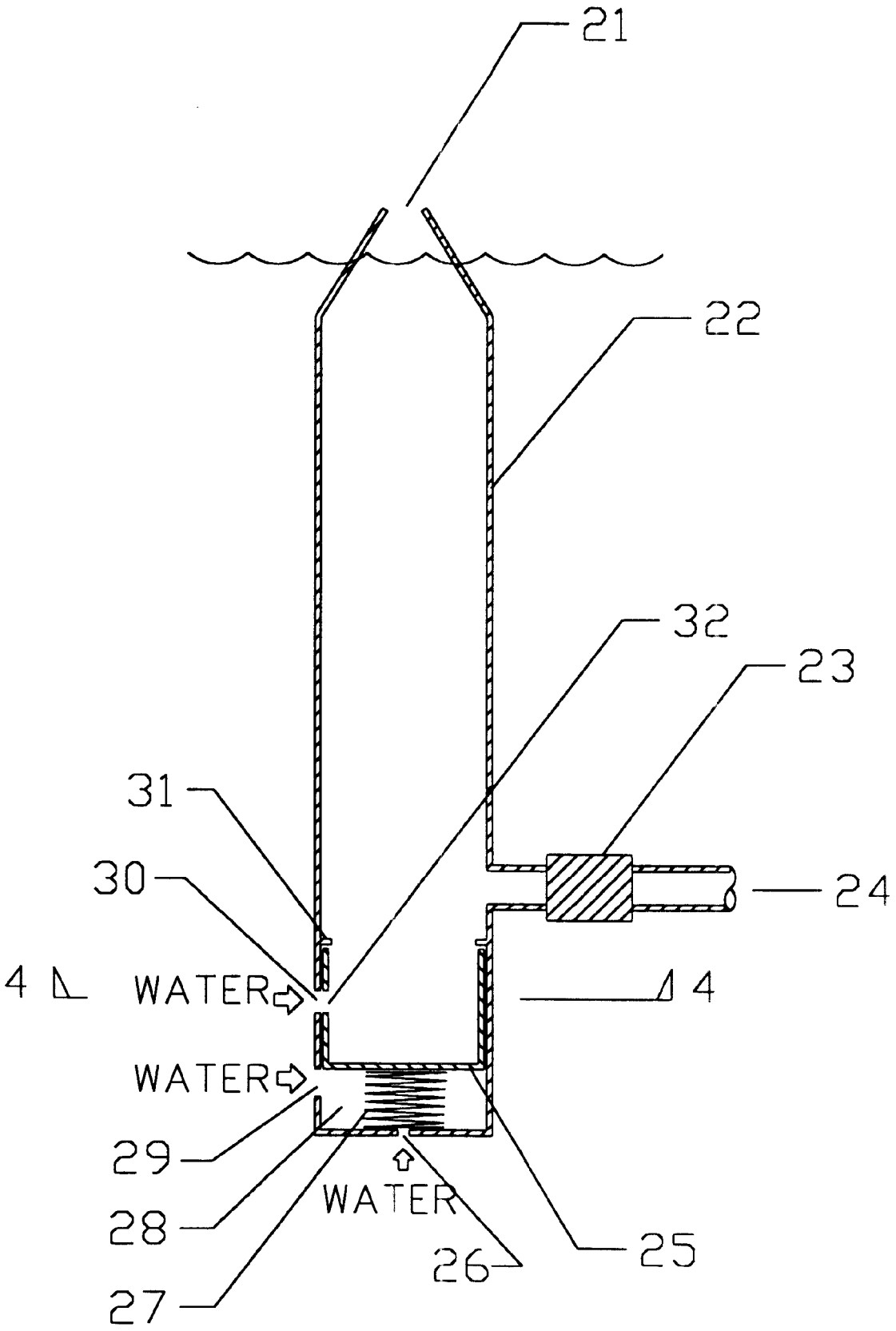
FIG. 1 is a sectional view that shows water flow directions when air control valve means is closed, and the sliding cylinder is fully up.

First referring to FIG. 1, the water ejecting device is submerged, at least in part, in a fountain pool, and is comprised of a water tank (22) with a small, smooth, tapered open end (21) at the top. The water tank could be simply a large diameter metal pipe, around 4" in diameter and 5 feet in length. The bottom of the water tank contains a spring (27), and a sliding cylinder (25). The sliding cylinder (25) is tightly fit inside the water tank (22), and there is only approximate 0.05" gap between water tank wall and the sliding cylinder (25). The sliding cylinder (25) could slide up and down inside the water tank (22). There is a stop ring (31) to stop the sliding cylinder (25) from sliding up too high, and there is a spring (27), that connects to the bottom of sliding cylinder (25) to the bottom of the water tank (22). The spring (27) pushes the sliding cylinder (25) up against the stop ring (31). On the sliding cylinder (25), there is hole (32) that matches hole (30) of the water tank (22). These holes are around 1" diameter. There are also hole (29) and hole (26) on the water tank (22). The hole (26) is small and around 0.15" diameter. The hole (29) is bigger and around 1" diameter. There is a connection port at the lower part of the water tank. This port is connected to an air control valve (23), which connects to the supply of air under pressure (24). The air control valve (23) is a two-way solenoid valve, which could be controlled by a computer.

When the air control valve (23) is closed, the force of the spring (27) push the sliding cylinder (25) up against the stop ring (31). At this location, hole (32) on the sliding cylinder (25) matches hole (30) on the water tank (22). These holes allow water from the pool to flow in and fill up the water tank (22), until the water levels inside the water tank (22) and the pool are the same. At the same time, water flows in hole (29), and hole (26), and fills the water chamber (28), which is located underneath the sliding cylinder (25).

Figure 2:
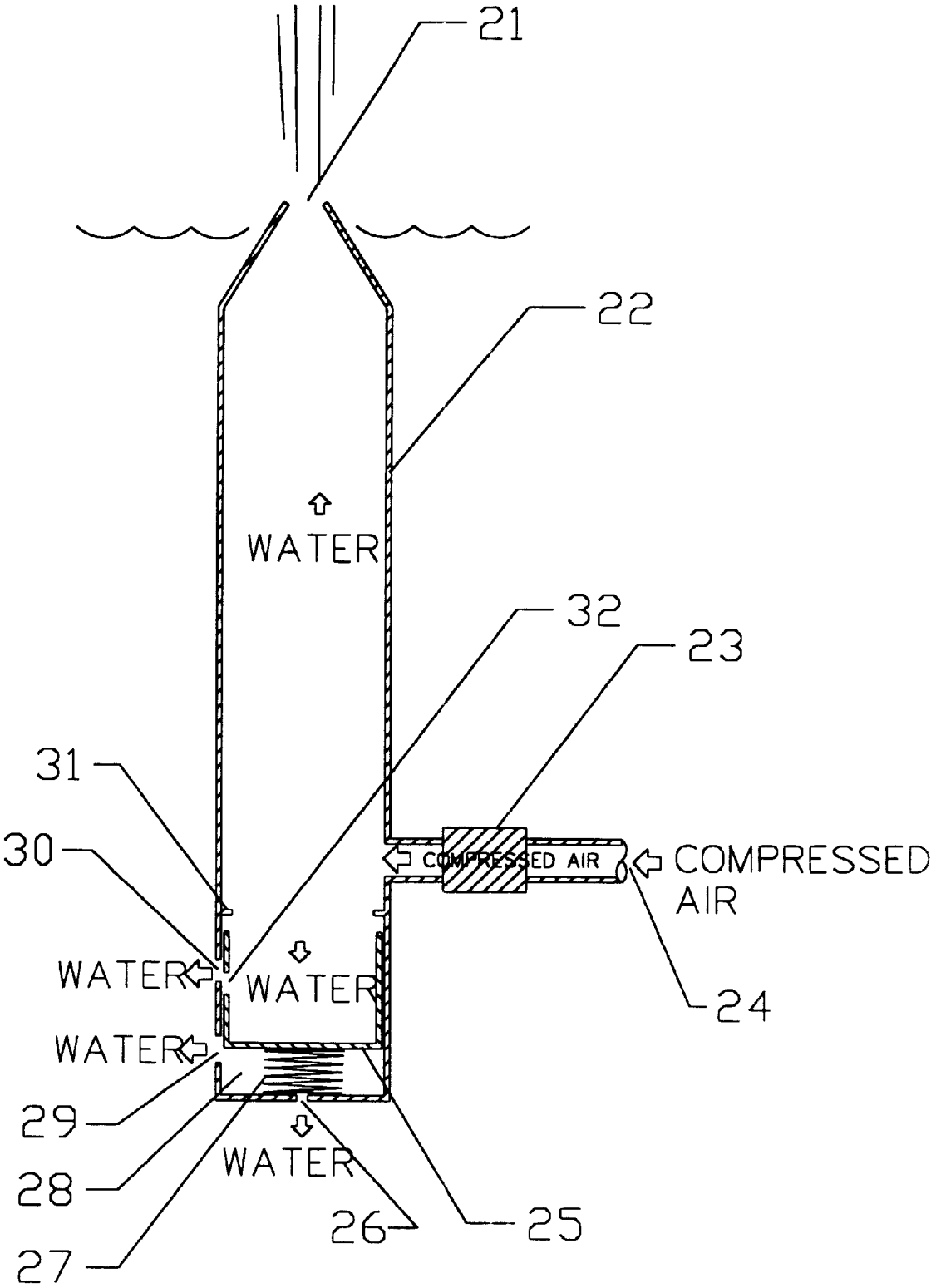
FIG. 2 is a sectional view that shows air and water flow directions at the moment that air control valve means is just open, and the sliding cylinder is half way down.

Referring to FIG. 2, when computer sends out an electrical signal, approximate 0.5 second in duration, to open the air control valve (23), the compressed air flows in the water tank (22) from the supply of air under pressure (24). The air pressure of the source of supply air (24) is around 40 psig. Since the air pressure is much higher the force of the spring (27), the sliding cylinder (25) will slide down quickly. At the same time, water inside the water tank (22) is pushed out by the compressed air at the open end (21) at the top, and also flows out at hole (30). Since the sliding cylinder (25) is moving down, water inside water chamber (28) is also pushed out at hole (29) and hole (26).

Figure 3:
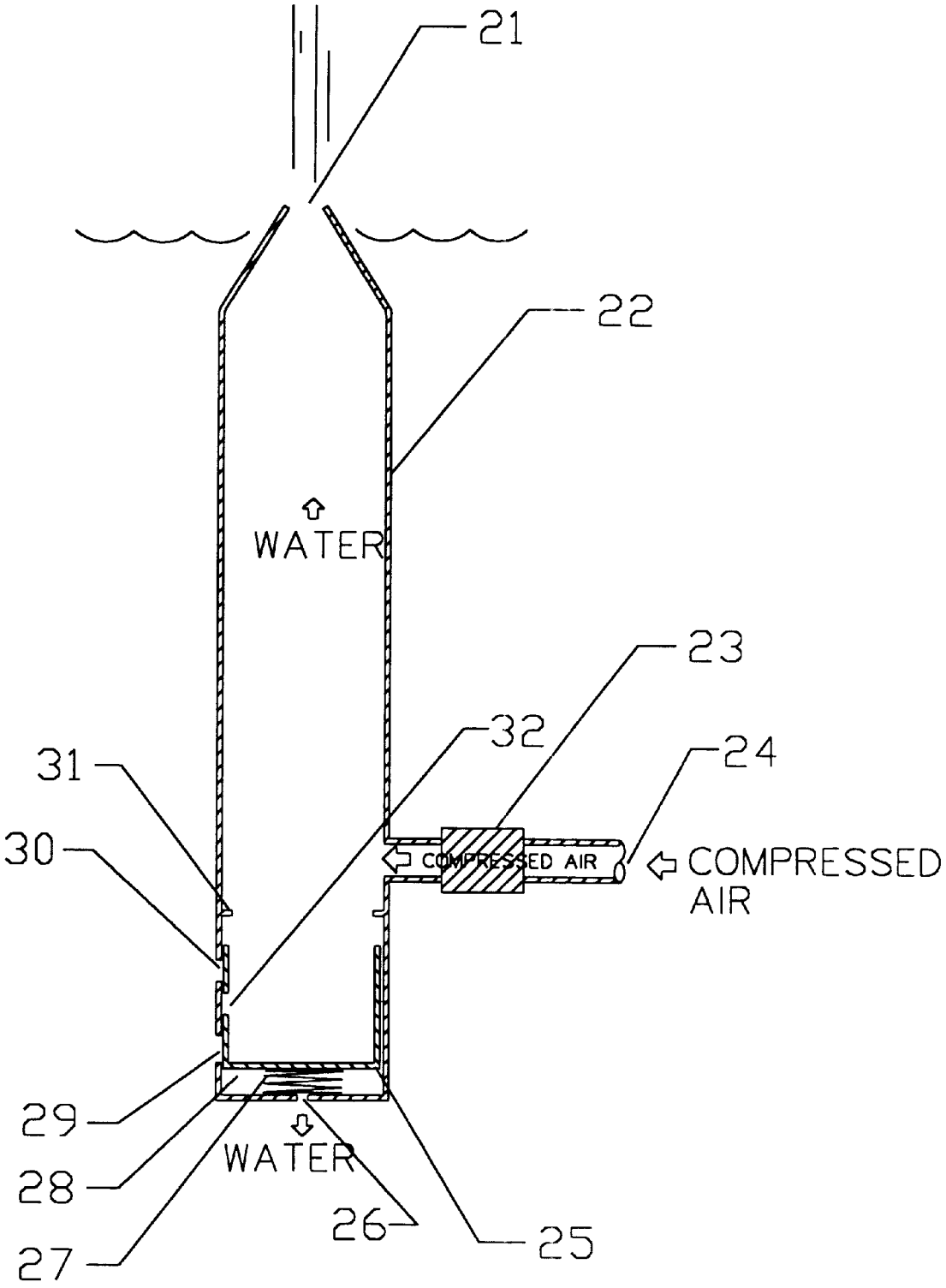
FIG. 3 is a sectional view that shows air and water flow directions after air control valve means is open, and the sliding cylinder is down.
Figure 4:
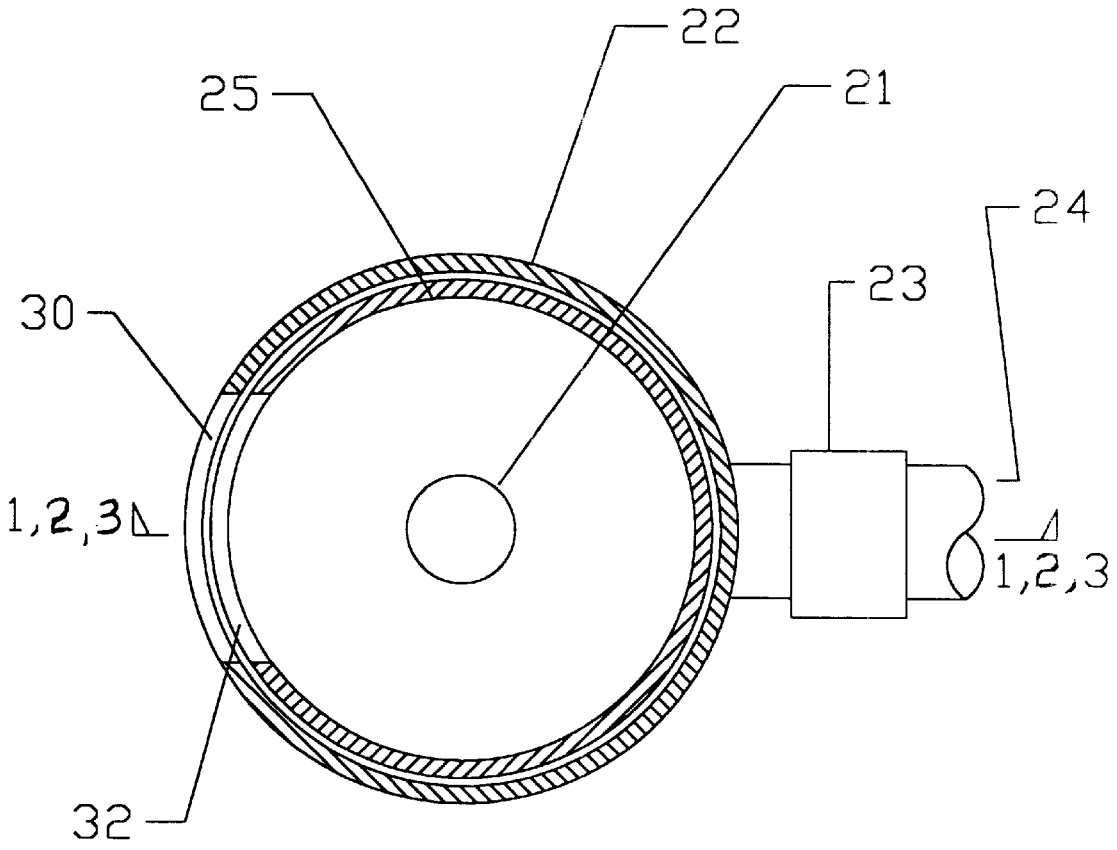
FIG. 4 is a sectional view that shows a section cutting through the water tank and sliding cylinder.

Referring to FIG. 3, after moving down more than 1", the sliding cylinder (25) wall now covers the hole (30), the water can not flow out at bole (30) any more, except a tiny amount leaking through 0.05" gap between the sliding cylinder (25) and water tank (22) wall. The same thing happens at hole (29) with that the sliding cylinder (25) wall blocks the hole (29), so that water can not flow out at hole (29), except a tiny amount leaking through the 0.05" gap between sliding valve (25) and water tank (22) wall. The other place that water is still flowing out is at hole (26), and at the open end (21) at the top. However, because hole (26) is quite small, not so much water could flow through hole (26). At this time, the water is trapped inside the water chamber (28) underneath the sliding cylinder (25). This water chamber (28) now functions as a shock absorber to absorb the momentum of the sliding cylinder in motion. Now, how fast the sliding cylinder (25) moves down is depending mostly on how much water is pushed out at hole (26). Since hole (26) is small, and not a lot of water could flow through, the sliding cylinder is slowing down rapidly, but not to a stop. As a result, most of water inside the water tank is pushed through the open end (21) at the top of the water tank (22).

Since the electrical signal from the control computer lasts only about 0.5 second, after 0.5 second, the air controls valve (23) returns back to the closed position. The residual compressed air inside the water tank (22), if any, will vent out through open end (21) at the top. When the pressure inside the water tank (22) is lower than the force of the spring (27), the spring force will push the sliding cylinder (25) up until the sliding cylinder (25) is stopped by stop ring (31). At this location, the hole (30) and hole (32) are matched, to allow water to flow in and refill the water tank (22) again. At the same time, water also flows in through hole (29) and hole (26) to refill water chamber (28) located underneath the sliding cylinder (25). Now the water tank (22) is refilled automatically. It is ready for the next electrical signal from the computer to activate air control valve again, and the whole cycle repeats.

Some of the prior art are using a check valve to refill the water tank. However, when the air control valve opens, the slamming action of the check valve when closes has been a major problem and creates frequent equipment damages and unreliable operations. The slamming action of a check valve also creates a loud disturbed noise.

I claim:

1. A water ejecting device comprising:

water tank means with tapered open end at the top, and disposed inside a pool of water;

air control valve means for controllably supplying air under pressure to said water tank means to force water therefrom and out said top open end of water tank, and, bi-directional flow automatic refilling and shock absorber means integral of the said water tank means.

2. The water ejecting device of claim 1 in which the bi-directional flow automatic refilling and shock absorber means while closing will create a water chamber that functions as a shock absorber to eliminate slamming action associated with fast closing of refilling means.

* * * * *